US009802776B2

(12) United States Patent
Fukusaka

(10) Patent No.: US 9,802,776 B2
(45) Date of Patent: Oct. 31, 2017

(54) SHEET CONVEYANCE APPARATUS AND IMAGE FORMING APPARATUS

(71) Applicant: CANON KABUSHIKI KAISHA, Tokyo (JP)

(72) Inventor: Tetsuro Fukusaka, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/918,344

(22) Filed: Oct. 20, 2015

(65) Prior Publication Data

US 2016/0114994 A1 Apr. 28, 2016

(30) Foreign Application Priority Data

Oct. 24, 2014 (JP) ..... 2014-217361

(51) Int. Cl.

| | |
|---|---|
| ***B65H 7/12*** | (2006.01) |
| ***B65H 43/04*** | (2006.01) |
| ***B65H 5/36*** | (2006.01) |
| ***B65H 29/62*** | (2006.01) |
| ***B65H 7/02*** | (2006.01) |
| ***G03G 15/00*** | (2006.01) |

(52) U.S. Cl.

CPC ..... *B65H 7/125* (2013.01); *B65H 5/36* (2013.01); *B65H 7/02* (2013.01); *B65H 29/62* (2013.01); *B65H 43/04* (2013.01); *G03G 15/703* (2013.01); *B65H 2404/632* (2013.01); *B65H 2511/22* (2013.01); *B65H 2511/524* (2013.01); *B65H 2515/112* (2013.01); *B65H 2515/40* (2013.01); *B65H 2553/30* (2013.01); *B65H 2801/06* (2013.01); *G03G 2215/00548* (2013.01); *G03G 2215/00637* (2013.01)

(58) Field of Classification Search

CPC ..... B65H 7/125; B65H 5/36; B65H 2511/22; B65H 2511/524; G03G 15/703

See application file for complete search history.

(56) References Cited

U.S. PATENT DOCUMENTS

| | | | | |
|---|---|---|---|---|
| 5,000,597 A * | 3/1991 | Kilb | B65H 5/062 | 400/247 |
| 5,029,837 A * | 7/1991 | Uchiyama | B65H 7/12 | 271/110 |
| 6,640,059 B2 * | 10/2003 | Fromm | B65H 5/062 | 399/124 |
| 7,889,344 B2 * | 2/2011 | Yamagishi | B65H 7/06 | 356/432 |
| 8,282,096 B2 * | 10/2012 | Pan | B65H 7/12 | 250/559.27 |
| 8,462,185 B2 * | 6/2013 | Iguchi | B65H 5/38 | 347/179 |

(Continued)

FOREIGN PATENT DOCUMENTS

| | | |
|---|---|---|
| JP | 2005-162426 A | 6/2005 |
| JP | 4410212 B2 | 2/2010 |

*Primary Examiner* — Patrick Cicchino

(74) *Attorney, Agent, or Firm* — Canon USA, Inc., IP Division

(57) ABSTRACT

A sheet conveyance apparatus including a transmission unit that transmits an ultrasonic wave toward a sheet and a reception unit that receives the ultrasonic wave includes a change unit that changes a distance of a conveyance path of the sheet according to sheet information about the sheet to be conveyed.

24 Claims, 13 Drawing Sheets

(56) References Cited

U.S. PATENT DOCUMENTS

| | | | | |
|---|---|---|---|---|
| 8,752,830 | B2 * | 6/2014 | Fukusaka | B65H 3/46 271/258.01 |
| 8,925,432 | B2 * | 1/2015 | Eoka | B65H 35/04 83/100 |
| 9,016,463 | B2 * | 4/2015 | Mimoto | B41J 3/4071 198/624 |
| 9,090,417 | B2 * | 7/2015 | Takamori | B65H 5/062 |

* cited by examiner

FIG.7

| GRAMMAGE [gsm] | CONVEYANCE PATH WIDTH [mm] | |
|---|---|---|
| ~ 70 | L1 | 1.0 |
| 71 ~ 100 | L2 | 2.0 |
| 101 ~ 150 | L3 | 3.0 |
| 151 ~ 250 | L4 | 4.0 |
| 251 ~ | L5 | 5.0 |

FIG.13

| GRAMMAGE [gsm] | CONVEYANCE PATH WIDTH [mm] | |
|---|---|---|
| ~ 200 | L6 | 2.0 |
| 201 ~ | L7 | 4.0 |

SHEET CONVEYANCE APPARATUS AND IMAGE FORMING APPARATUS

BACKGROUND OF THE INVENTION

Field of the Invention

The present invention relates to a sheet conveyance apparatus and an image forming apparatus including the sheet conveyance apparatus.

Description of the Related Art

Japanese Patent Application Laid-Open No. 2005-162426 discusses an apparatus that detects overlapping (double feed) of sheets during conveyance by an ultrasonic sensor. Japanese Patent No. 4410212 discusses an apparatus including a double feed detecting sensor that detects double feed of sheets and configured to detect double feed of sheets by the double feed detecting sensor in an area which is adjacent to a nipping location of sheet and in which the amplitude of sheet is restricted.

When double feed of sheets is detected using an ultrasonic sensor, it is desirable that the orientation of sheets is stable in order to reduce variations of detected data by the ultrasonic sensor. Sheet grammage is sometimes determined using an ultrasonic sensor and also in this case, it is desirable that the orientation of sheets is stable.

In the apparatus, like the one discussed in Japanese Patent No. 4410212, a double feed detecting sensor is arranged in an area adjacent to a nipping location of sheet, the displacement width of sheet is restricted and the orientation of sheet is stabilized, but the following problem arises: an air layer between doubly-fed sheets is reduced and attenuation of an ultrasonic wave by the air layer is reduced. Then, depending on the type of sheet, it becomes difficult to determine double feed using the attenuation of an ultrasonic wave by the air layer. If the attenuation of an ultrasonic wave by the air layer is reduced, the precision of detection of sheet grammage is also deteriorated.

SUMMARY OF THE INVENTION

According to an aspect of the present invention, a sheet conveyance apparatus includes a transmission unit configured to transmit an ultrasonic wave toward a sheet being conveyed, a reception unit arranged opposite to the transmission unit across the sheet and configured to receive the ultrasonic wave, a conveyance guide unit configured to form a conveyance path through which the sheet being conveyed between the transmission unit and the reception unit passes, and a change unit configured to change a distance of the conveyance path in a thickness direction of sheet according to sheet information about the sheet to be conveyed.

Further features of the present invention will become apparent from the following description of exemplary embodiments with reference to the attached drawings.

BRIEF DESCRIPTION OF THE DRAWINGS

FIG. 7 is a diagram illustrating a relationship between grammage of sheets and a conveyance path width to be set.

FIG. 13 is a diagram illustrating the relationship between sheet grammage and a conveyance path width to be set in the modified example.

DESCRIPTION OF THE EMBODIMENTS

Various exemplary embodiments, features, and aspects of the present invention will be described in detail with reference to the drawings.

<Overview of Image Forming Apparatus>

Figure 1:
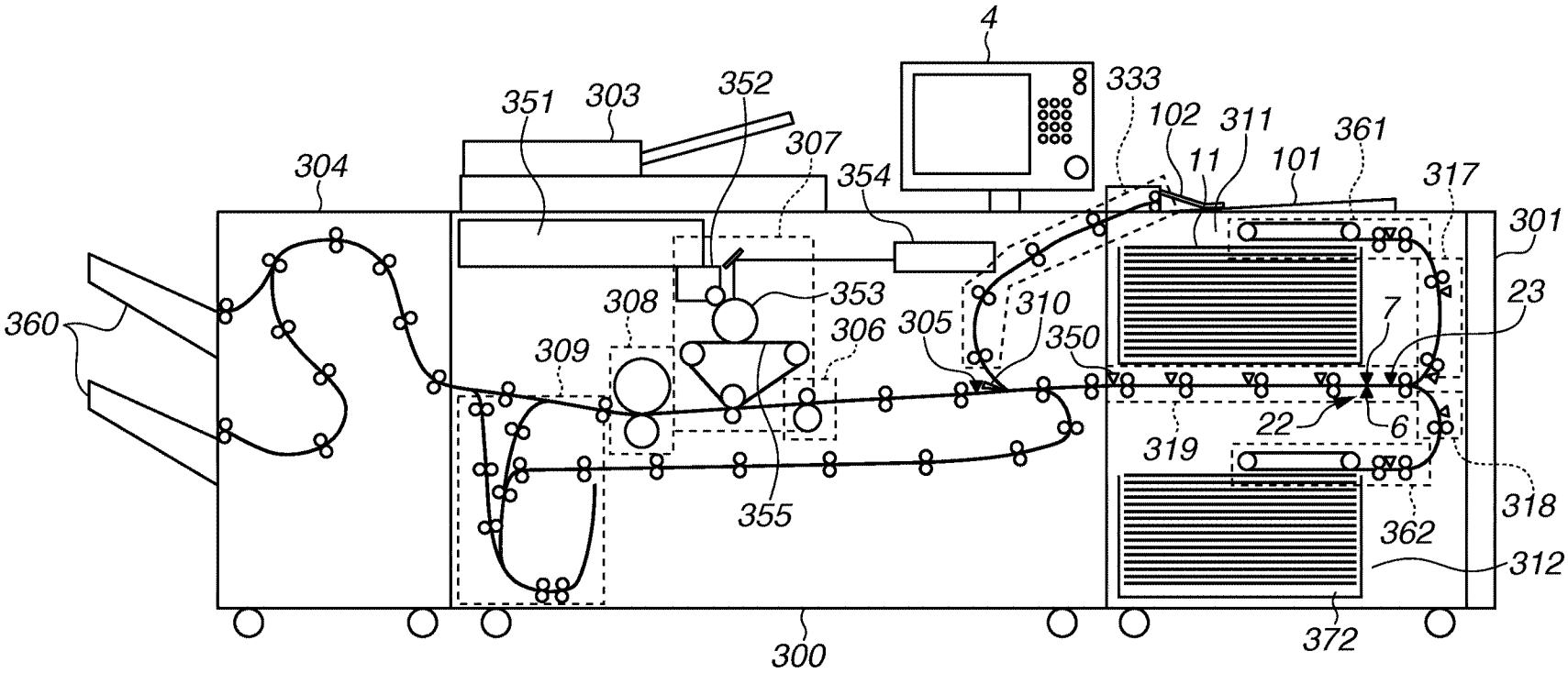
FIG. 1 is a schematic diagram illustrating an image forming apparatus.

The configuration of an image forming apparatus according to an exemplary embodiment of the present invention will be described using FIG. 1. In FIG. 1, the image forming apparatus includes a sheet feeding apparatus 301, an image forming apparatus body 300, an operation unit 4, a reader scanner 303, and a post-processing apparatus 304.

The sheet feeding apparatus 301 includes two sheet feeding units 311 and 312. Each of the sheet feeding units 311 and 312 stores a sheet bundle in storages 11 and 372, respectively. The storages 11 and 372 are loading units onto which a plurality of sheets is loaded. Each of the sheet feeding units 311 and 312 feeds sheets from the storages 11 and 372, respectively. An escape tray 101 to which doubly-fed sheets are discharged is provided on the top surface of the sheet feeding apparatus 301. A full-load sensor 102 detects whether the escape tray 101 are full with discharged sheets.

A feeding operation of sheets stored in the sheet feeding units 311 and 312 is performed by feeding units 361 and 362 provided in the sheet feeding units 311 and 312, respectively. A sheet fed from the sheet feeding unit 311 is conveyed to an upper conveyance unit 317. A sheet fed from the sheet feeding unit 312 is conveyed to a lower conveyance unit 318. The lower conveyance unit 318 and the upper conveyance unit 317 join a joined conveyance unit 319. A sheet conveyed by the lower conveyance unit 318 or the upper conveyance unit 317 is conveyed by the joined conveyance unit 319.

Though not illustrated in the upper conveyance unit 317, the lower conveyance unit 318, and the joined conveyance unit 319, each of the units has a stepping motor for rotating the respective conveyance rollers. Sheets are conveyed in such a manner that a conveyance control unit controls these motors to rotate the conveyance rollers.

A detection unit 22 is arranged in the joined conveyance unit 319. The detection unit 22 includes a transmission element (transmission unit) 6 that transmits an ultrasonic wave to detect double feed or sheet grammage and a reception element (reception unit) 7 that receives an ultrasonic wave which has been transmitted from the transmission element 6 and has passed through sheets. The detection unit 22 will be described in detail below.

The sheet feeding apparatus 301 as a sheet conveyance apparatus that conveys sheets successively conveys sheets stored in each of the storages 11 and 372 to the image forming apparatus body 300 according to sheet request information from the image forming apparatus body 300. The sheet feeding apparatus 301 conveys a sheet to a conveyance sensor 350 provided in a transfer portion to the image forming apparatus body 300 and notifies the image forming apparatus body 300 of the completion of transfer preparation.

Upon receipt of the completion of transfer preparation from the sheet feeding apparatus 301, the image forming apparatus body 300 sends notification of a transfer request. The sheet feeding apparatus 301 successively conveys sheets one by one to the image forming apparatus body 300 each time a transfer request is received. When the tip of a sheet sent out from the sheet feeding apparatus 301 reaches the nip of the most upstream conveyance rollers of the image forming apparatus body 300, the sheet is pulled out by the conveyance rollers of the image forming apparatus body 300 and discharged from the sheet feeding apparatus 301. The sheet feeding apparatus 301 ends the feeding operation at the point of when as many sheets as requested by the image forming apparatus body 300 have been conveyed. Then, the sheet feeding apparatus 301 ends the operation after discharging the sheet into the image forming apparatus body 300 and then shifts to a standby state.

The image forming apparatus body 300 notifies the sheet feeding apparatus 301 of the transfer request and also pulls out a sheet after another from the sheet feeding apparatus 301 to successively form an image on the sheet.

The operation unit 4 with which a user performs operation settings for the image forming apparatus and the reader scanner 303 for reading a document image are arranged in an upper portion of the image forming apparatus body 300. The image forming apparatus body 300 conveys a sheet after reception of the sheet from the sheet feeding apparatus 301 connected to the image forming apparatus body 300.

A flapper 310 which is a swing guide freely swingable guides a sheet selectively to the escape tray 101 in a case where double feed of sheets is detected by the detection unit 22 and to an image forming device (image forming unit) 307 in a case where double feed of sheets is not detected. Thus, in a case where double feed of sheets is detected, the sheets are discharged to the escape tray 101 by an escape conveyance unit 333. In a case where double feed of sheets is not detected, an image forming operation based on image data received by the image forming device 307 is performed starting with the sheet detection by an image reference sensor 305.

In the present exemplary embodiment, the escape conveyance unit 333 that discharges a sheet to the escape tray 101 is arranged in the image forming apparatus body 300, but a configuration in which the escape conveyance unit 333 is arranged in the sheet feeding apparatus 301 may also be adopted.

Next, the formation of an image on a sheet will be described. A semiconductor laser of a laser scanner unit 354 is turned on and light quantity control is exercised. A scanner motor that controls the rotation of a polygon mirror (not illustrated) is controlled. Then, a latent image is formed on a photosensitive drum 353 by laser light based on image data. A development unit 352 to which toner is fed from a toner bottle 351 develops the latent image on the photosensitive drum 353 using the toner. The developed toner image is primarily transferred from the photosensitive drum 353 to an intermediate transfer belt 355. The toner image transferred onto the intermediate transfer belt 355 is secondarily transferred to the sheet.

A registration conveyance unit 306 is arranged immediately before the secondary transfer position. The registration conveyance unit 306 performs skew correction of a sheet and position adjustments between a toner image formed on the intermediate transfer belt 355 and the sheet without stopping the sheet.

The sheet onto which a toner image has been transferred is conveyed to a fixing unit 308. The fixing unit 308 fuses the toner by applying heat and pressure to fix the toner to the sheet. After the fixing, the back surface of the sheet is subsequently printed or if the sheet is reversed and conveyed to the post-processing apparatus 304, the sheet is reversed and conveyed by a reverse conveyance unit 309. If there is no need to reverse the sheet, the sheet is directly conveyed to the post-processing apparatus 304 provided downstream side of the image forming apparatus body 300.

The post-processing apparatus 304 is connected to the downstream side of the image forming apparatus body 300. The post-processing apparatus 304 performs desired post-processing (folding, stapling, and punching) set by the user through the operation unit 4 on the sheet after an image is formed. The post-processing apparatus 304 successively outputs the sheets to a discharge tray 360 as products, which are then provided to the user.

<Outline Configuration of Double Feed Detecting Unit>

Figure 2:
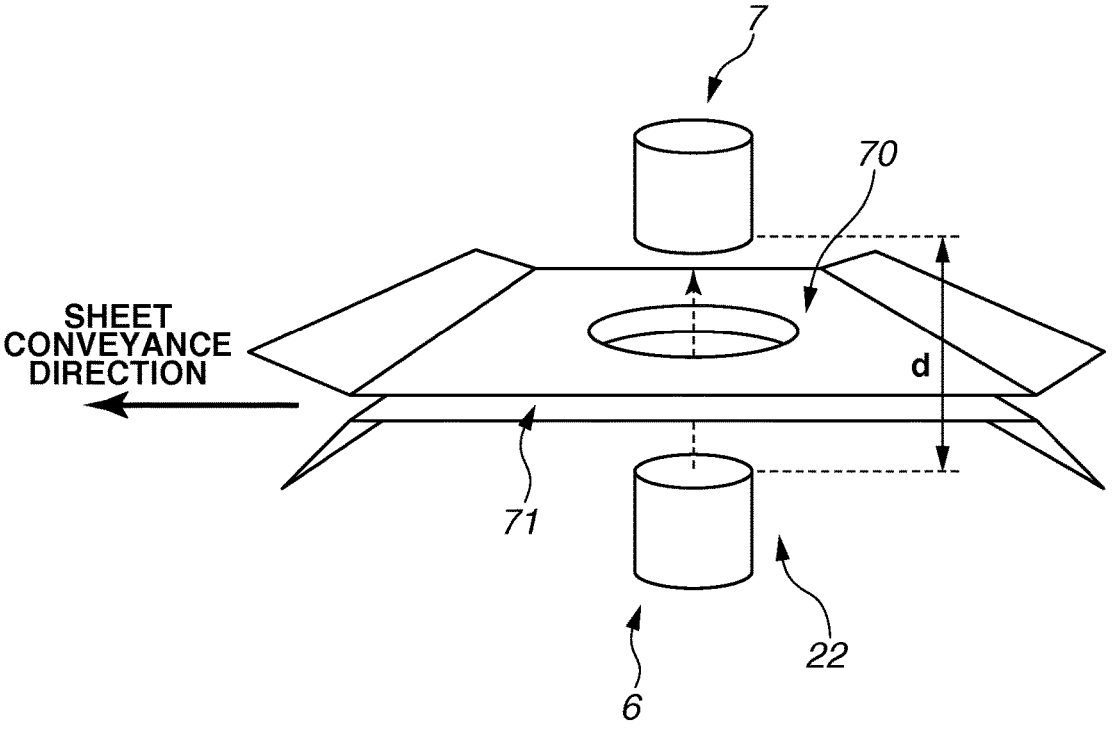
FIG. 2 is a schematic diagram illustrating a detection unit of a sheet feeding apparatus.

FIG. 2 is a diagram illustrating the arrangement of the transmission element 6 and the reception element 7 in the detection unit 22. The detection unit 22 according to the present exemplary embodiment adopts an ultrasonic sensor. Across a conveyance path through which the sheets pass, the transmission element 6 is arranged on the lower side and the reception element 7 is arranged on the upper side opposite to each other with a distance d away from each other. An upper conveyance guide (first guide member) 70 and a lower conveyance guide (second guide member) 71 that guide a sheet 35 being conveyed near a detection area of the detection unit 22 are arranged. The distance between the upper conveyance guide 70 and the lower conveyance guide 71 in the vertical direction, that is, the distance between the upper conveyance guide 70 and the lower conveyance guide 71 in the thickness direction of the sheet 35 being conveyed is changed by guide moving motors 73 and 74 (see FIGS. 3 and 8) that are not illustrated in FIG. 2. Details of changing the distance between the upper conveyance guide 70 and the lower conveyance guide 71 in the thickness direction of sheets will be described below. An opening is provided in an area of the upper conveyance guide 70 and the lower conveyance guide 71 constituting a conveyance guide unit to form a conveyance path of the sheet 35 being conveyed, through which an ultrasonic signal is propagated from the transmission element 6 to the reception element 7 so that an ultrasonic signal is not interfered.

<Circuit Block Configuration>

Figure 3:
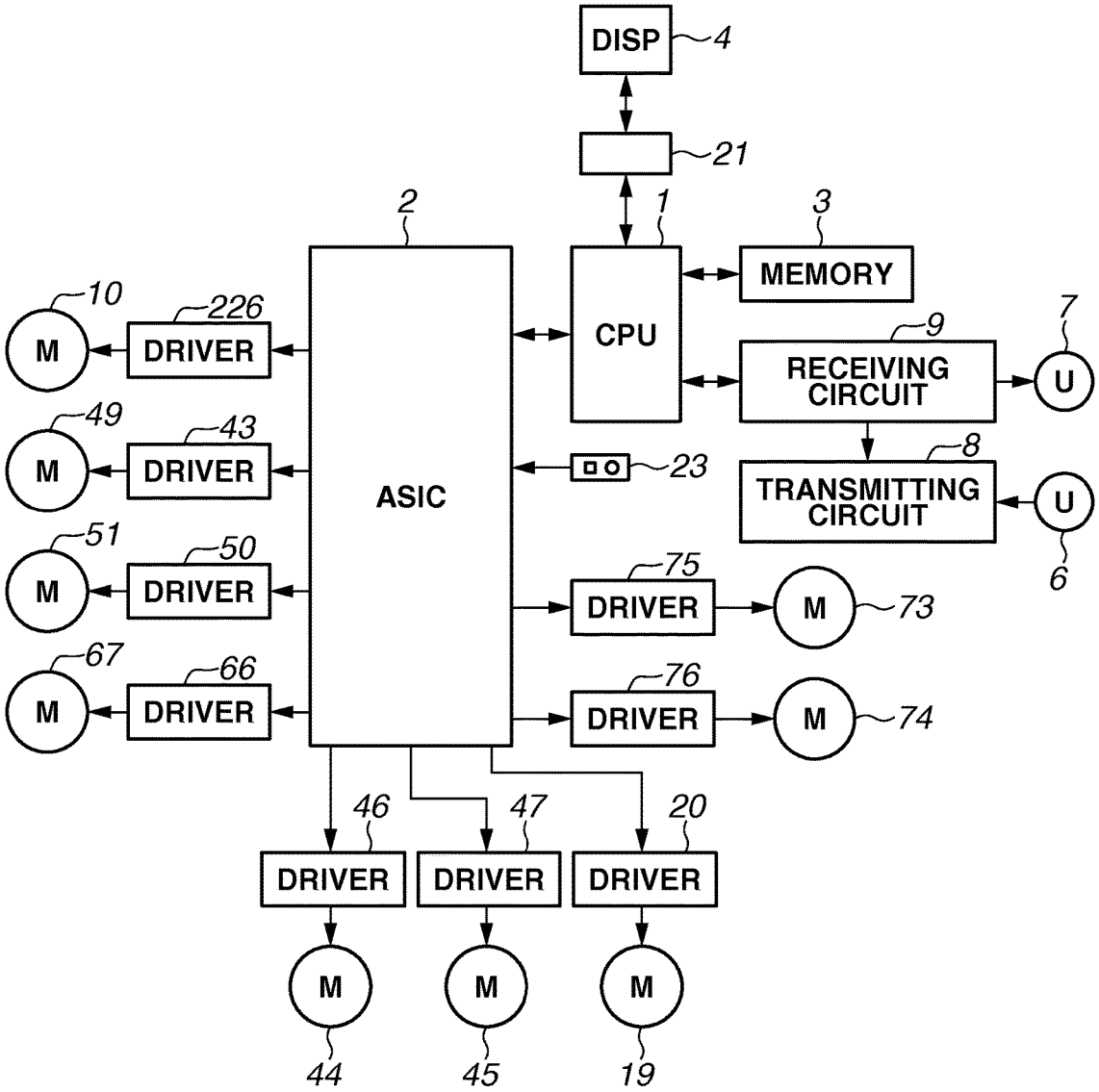
FIG. 3 is a schematic diagram illustrating a circuit block of the sheet feeding apparatus.

FIG. 3 is a diagram illustrating a circuit block configuration of the sheet feeding apparatus 301.

A dedicated application specific integrated circuit (ASIC) 2 that drives various loads of the sheet feeding apparatus 301, such as a motor and a fan, is connected to a central processing unit (CPU) 1 as a control unit of the sheet feeding apparatus 301. Also, an interface 21, to which information is sent from the operation unit 4 and which serves as a setting unit being used for inputting and setting sheet information, such as the size, grammage, and surface properties of sheets, is connected to the CPU 1. Further, a storage device 3 that stores various kinds of data acquired by the interface 21 as an acquisition unit that acquires information and target values used for controlling various operations is connected to the CPU 1.

A drive circuit 226 drives a lower conveyance motor 10 that rotates a conveyance roller of the lower conveyance unit 318. A drive circuit 43 drives an upper conveyance motor 49 that rotates a conveyance roller of the upper conveyance unit 317. A drive circuit 50 drives a joined conveyance motor 51 that rotates a conveyance roller of the joined conveyance unit 319. A drive circuit 66 drives an escape conveyance motor 67 that rotates a conveyance roller of the escape conveyance unit 333.

A drive circuit 75 drives an upper guide moving motor 73 that moves the upper conveyance guide 70 among the conveyance guides 70 and 71 that guide sheets conveyed in a detection area of the detection unit 22. Similarly, a drive circuit 76 drives a lower guide moving motor 74 that moves the lower conveyance guide 71.

A transmission circuit 8 that generates and sends a transmission signal to the transmission element 6 of the detection unit 22 and a reception circuit 9 that receives a reception signal from the reception element 7 are connected to the CPU 1. A control integrated circuit (IC) that calculates a reception signal and performs double feed detection and grammage detection of sheets is located inside the reception circuit 9. The control IC outputs a drive signal of the transmission element 6 to the transmission circuit 8. Double feed information and grammage information of sheets detected by the reception circuit 9 is sent to the CPU 1 via serial communication between the control IC and the CPU 1.

According to the present exemplary embodiment, the operation unit 4 is mounted on the image forming apparatus body 300. However, the operation unit 4 may be mounted on the sheet feeding apparatus 301.

<Received Waveform of Double Feed Detecting Unit>

Figure 4:
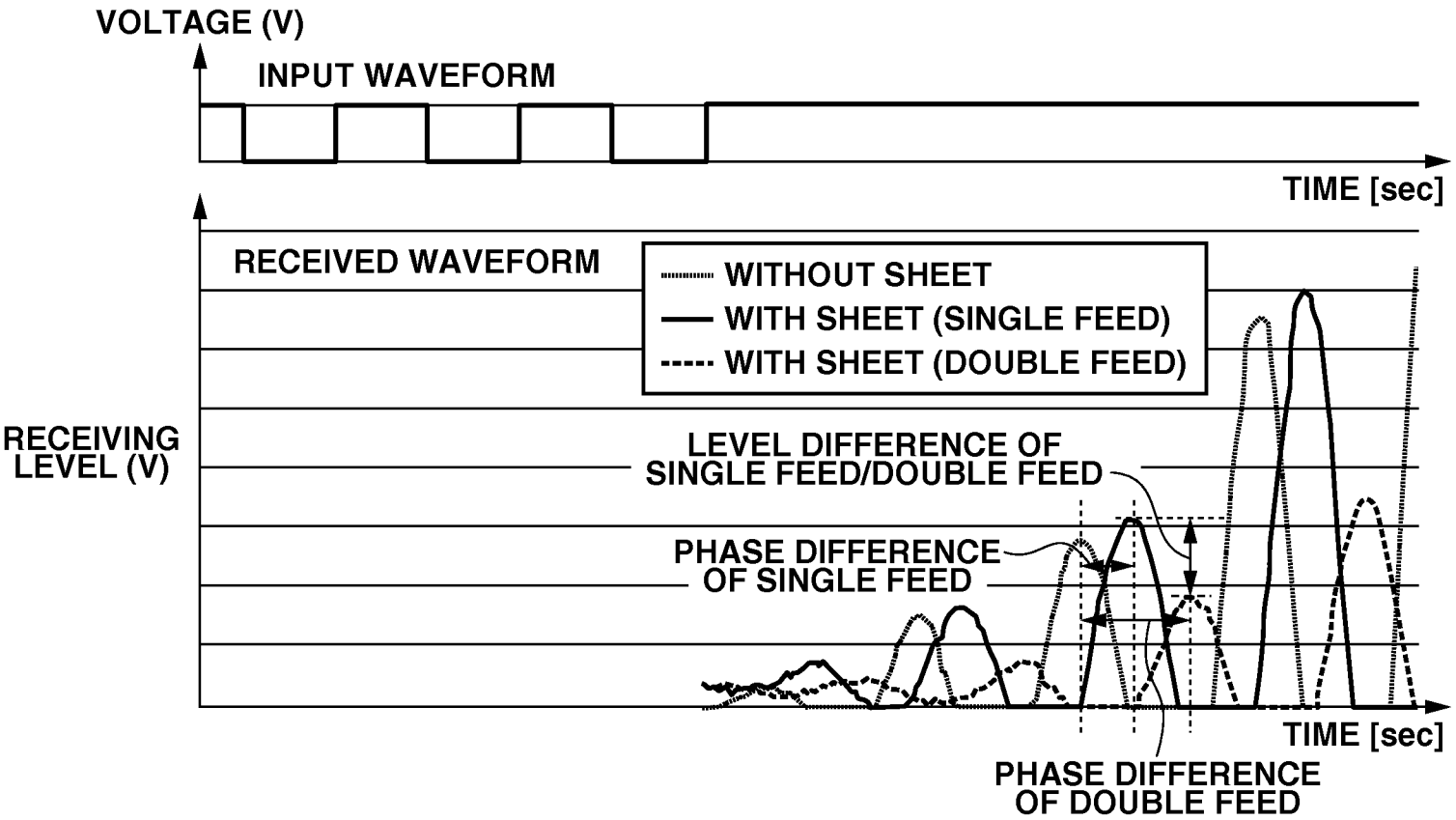
FIG. 4 is a diagram illustrating a double feed detecting sensor signal during sheet conveyance.

FIG. 4 is a diagram illustrating an input signal waveform into the transmission circuit 8 of the detection unit 22 and received waveforms by the reception circuit 9. The input signal indicates that a predetermined number of pulses (three pulses in FIG. 4) of a burst wave of a predetermined voltage and a predetermined frequency are input. FIG. 4 illustrates a received waveform without sheets, a received waveform with a sheet (one-sheet conveyance=single feed), and a received waveform with sheets (two-sheet conveyance=double feed). In FIG. 4, waveforms at the same period of time are illustrated after an input signal is input into the transmission circuit 8 and the signal is transmitted by the transmission element 6.

It is evident here that relative to the received waveform without sheets, the received waveform during single feed and the received waveform during double feed have shifted phases in the peak positions of the received waveforms. It is also evident that there is a level (=voltage) difference between the reception level (=voltage) of the peak position during single feed in which the phase is shifted and the reception level (=voltage) of the peak position during double feed. Whether double feed of sheets occurs is determined based on such a phase difference and a level difference. Also, the reception level in the peak position of a received waveform is calculated and converted into grammage to detect the grammage of sheets being conveyed.

Information (signal) indicating double feed of sheets issued by the control IC of the reception circuit 9 is sent to the CPU 1 and the CPU 1 determines that double feed of sheets has occurred based on the information. In a case where the CPU 1 determines that double feed of sheets has occurred, the CPU 1 transmits a signal indicating an occurrence of double feed to the image forming apparatus body 300. Then, as described above, the image forming apparatus body 300 causes the flapper 310 to guide the doubly-fed sheets to the escape tray 101.

In the present exemplary embodiment, the doubly-fed sheets are conveyed to the escape tray 101 when double feed is detected. However, when double feed is detected, a screen of the operation unit 4 may be caused to display a message prompting the user to remove sheets held in the conveyance path after the conveyance of the sheets is stopped. Grammage information of sheets issued by the control IC of the reception circuit 9 is sent to the image forming apparatus body 300. The image forming apparatus body 300 changes the temperature of the fixing unit 308 according to the detected grammage of sheets.

Figure 5:
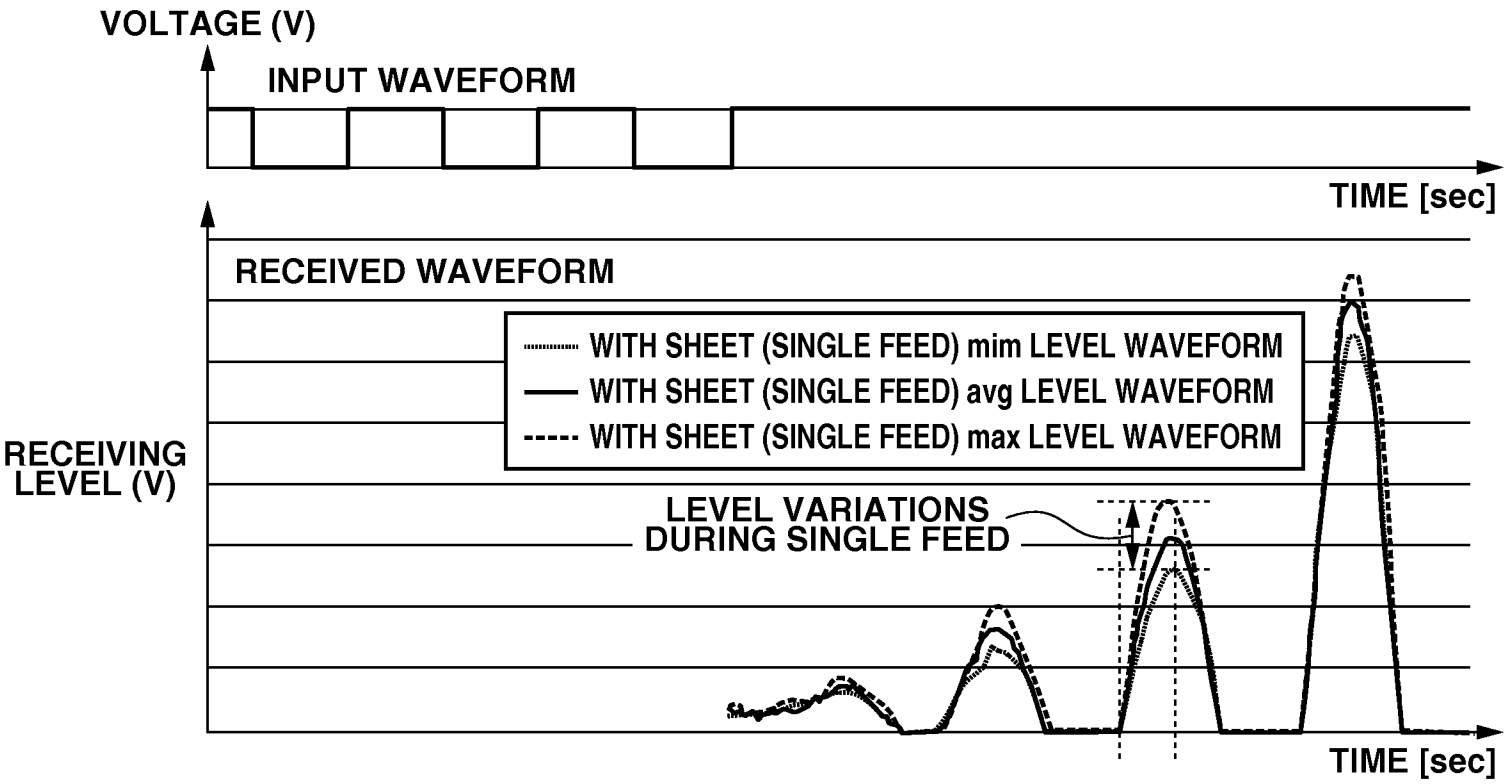
FIG. 5 is a diagram illustrating the double feed detecting sensor signal during sheet conveyance.

FIG. 5 is, like FIG. 4, a diagram illustrating the input signal waveform into the transmission circuit 8 of the detection unit 22 and received waveforms by the reception circuit 9. FIG. 5 indicates that reception levels (voltages) in the peak position of received waveforms with a sheet (one-sheet conveyance=single feed) vary. Due to variations, the precision of grammage detection that detects the grammage of sheets to be conveyed by calculating the reception level in the peak position of a received waveform and converting the reception level into grammage deteriorates. The cause of variations is an unstable sheet orientation in a detection area of the detection unit 22. It is because a sheet during conveyance is conveyed through the conveyance path without the vertical position being fixed. Thus, it is desirable that the sheet orientation of a sheet being conveyed in the detection area of the detection unit 22 is stabilized. Therefore, in the present exemplary embodiment, the orientation of a sheet during conveyance to be detected is stabilized as described below.

<Configuration and Operation of Conveyance Guide Near Double Feed Detecting Unit>

Figure 6A:
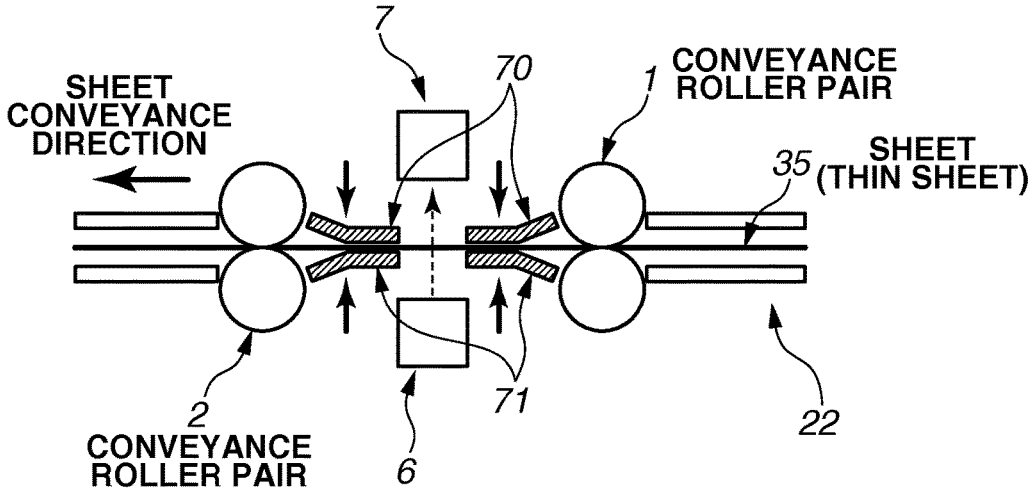
FIGS. 6A and 6B are diagrams each illustrating a conveyance path width change of the sheet feeding apparatus.
Figure 6B:
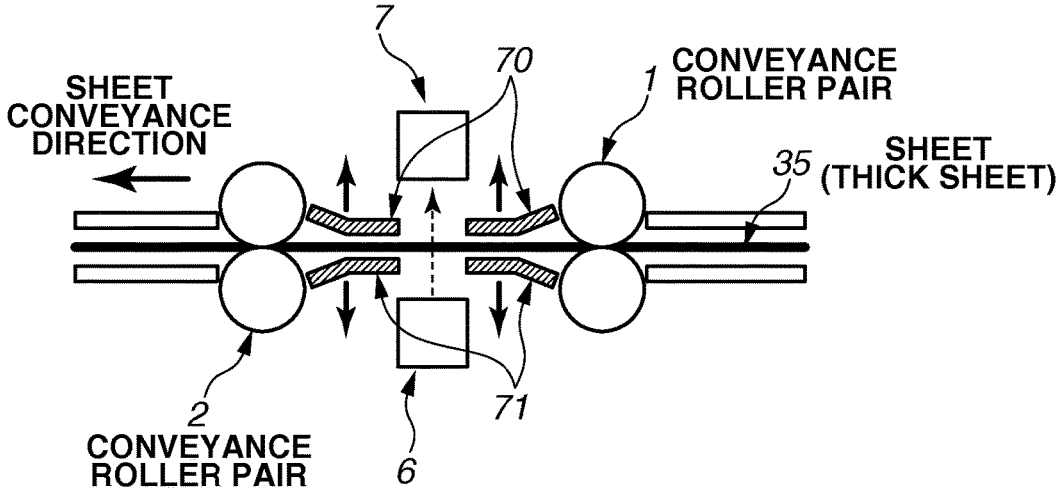
Figure 8A:
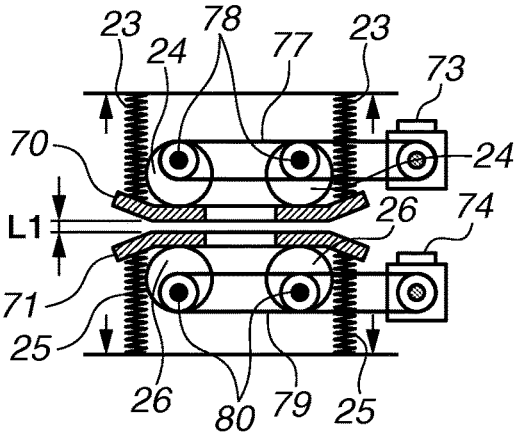
FIGS. 8A to 8E are diagrams each illustrating an operation of the conveyance path width change of the sheet feeding apparatus.
Figure 8B:
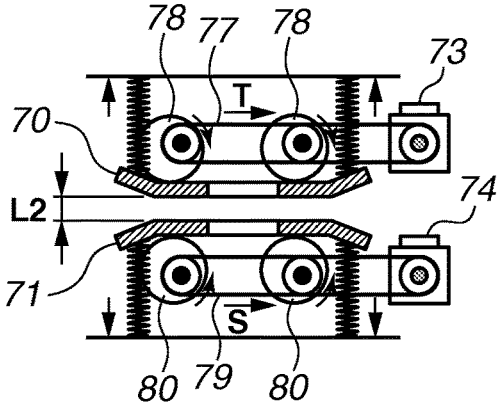
Figure 8C:
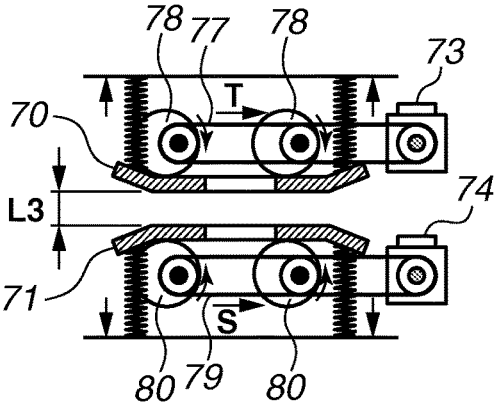
Figure 8D:
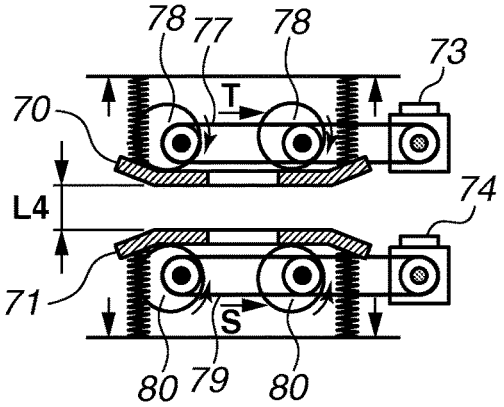
Figure 8E:
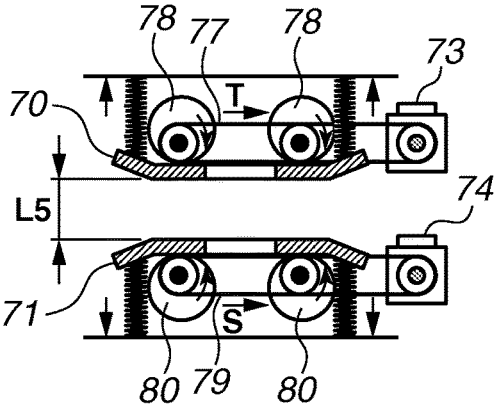

FIGS. 6A and 6B are diagrams illustrating how the conveyance path width in an ultrasonic sensor detection position of the sheet feeding apparatus 301 is changed depending on the grammage (thickness) of sheets conveyed. The upper conveyance guide 70 regulates the sheet orientation in a detection position of the detection unit 22 and the lower conveyance guide 71 similarly regulates the sheet orientation. The conveyance path width here is a distance of the conveyance path formed by the upper conveyance guide 70 and the lower conveyance guide 71 in the thickness direction of sheets to be conveyed and a distance between the upper conveyance guide 70 and the lower conveyance guide 71 in the thickness direction of sheets.

Thin paper of small grammage narrows the conveyance path width (FIG. 6A) and thick paper of large grammage widens the conveyance path width (FIG. 6B). By changing the conveyance path width according to grammage of sheets in this manner, sheets can be conveyed in a stable sheet orientation without the sheets fluttering. Then, if double feed occurs even in a stable sheet orientation, an air layer is secured between sheets. Therefore, the precision of detecting double feed and grammage of sheets is high.

In the present exemplary embodiment, as described above, the conveyance path width suitable for each grammage can be adopted. By changing the conveyance path width according to the grammage of sheets as illustrated in FIGS. 6A and 6B, variations of the received waveform illustrated in FIG. 5 are reduced and the precision of detecting double feed and grammage of sheets is improved.

FIG. 7 is a diagram illustrating the relationship between the grammage of sheets to be conveyed and the conveyance path width to be set in the sheet feeding apparatus 301. In the sheet feeding apparatus 301, the conveyance path width to be set is selected in five stages of L1 to L5 as illustrated in FIG. 7 based on the sheet grammage of a sheet feed stage set through the operation unit 4 as an operation unit.

FIGS. 8A to 8E are diagrams illustrating a mechanism including the guide moving motors (driving units) 73 and 74 for moving the upper conveyance guide 70 and the lower conveyance guide 71 and the operation thereof to implement the change of the conveyance path width described with reference to FIG. 7.

The upper conveyance guide 70 is vertically movably supported and an upward force is applied by a first spring 23. The movement in an upward arrow direction of the upper conveyance guide 70 is regulated by a first cam 24. The first cam 24 is provided coaxially with an upper guide moving roller 78 connected to the upper guide moving motor 73 via an upper guide moving belt 77.

The lower conveyance guide 71 is vertically movably supported and a downward force is applied by a second spring 25. The movement in a downward arrow direction of the lower conveyance guide 71 is regulated by a second cam 26. The second cam 26 is provided coaxially with a lower guide moving roller 80 connected to the lower guide moving motor 74 via a lower guide moving belt 79.

The guide moving motors 73 and 74, the upper guide moving roller 78, the first cam 24, the upper guide moving belt 77, the lower guide moving belt 79, the lower guide moving roller 80, and the second cam 26 are included in a change unit that changes the conveyance path width.

The upper guide moving belt 77 is rotated in a T direction in FIGS. 8B to 8E by the rotation of the upper guide moving motor 73 and the first cam 24 is rotated by the rotation of the upper guide moving roller 78 connected to the upper guide moving belt 77. With the rotation of the first cam 24, the upper conveyance guide 70 moves vertically.

Similarly, the lower guide moving belt 79 is rotated in an S direction in FIGS. 8B to 8E by the rotation of the lower guide moving motor 74 and the second cam 26 is rotated by the rotation of the lower guide moving roller 80 connected to the lower guide moving belt 79. With the rotation of the second cam 26, the lower conveyance guide 71 moves vertically.

Thus, the distance (conveyance path width) between the upper conveyance guide 70 and the lower conveyance guide 71 can be changed by controlling the rotation amount of the upper guide moving motor 73 and the lower guide moving motor 74. That is, by driving the upper guide moving motor 73 and the lower guide moving motor 74, the conveyance path width can be changed from L1 of the minimum conveyance path width illustrated in FIG. 8A to the conveyance path width L2 illustrated in FIG. 8B. Further, by driving the upper guide moving motor 73 and the lower guide moving motor 74, the conveyance path width can be changed to the conveyance path width L3 illustrated in FIG. 8C or the conveyance path width L4 illustrated in FIG. 8D. Further, by driving the upper guide moving motor 73 and the lower guide moving motor 74, the conveyance path width can be changed to L5 of the maximum conveyance path width illustrated in FIG. 8E.

In this manner, the conveyance path width is changed to a conveyance path width according to the grammage of sheets as described with reference to FIG. 7 by vertically moving the upper conveyance guide 70 and the lower conveyance guide 71. The initial value of the conveyance path width is L5 and the position thereof is determined by a home position sensor (not illustrated).

A form in which the conveyance path width is changed stepwise from L1 to L5 is illustrated, but there is no need to change the conveyance path by a width stepwise manner and the conveyance path width may be changed according to the grammage of sheets by rotating the guide moving motors 73 and 74 by a desired amount.

Figure 9:
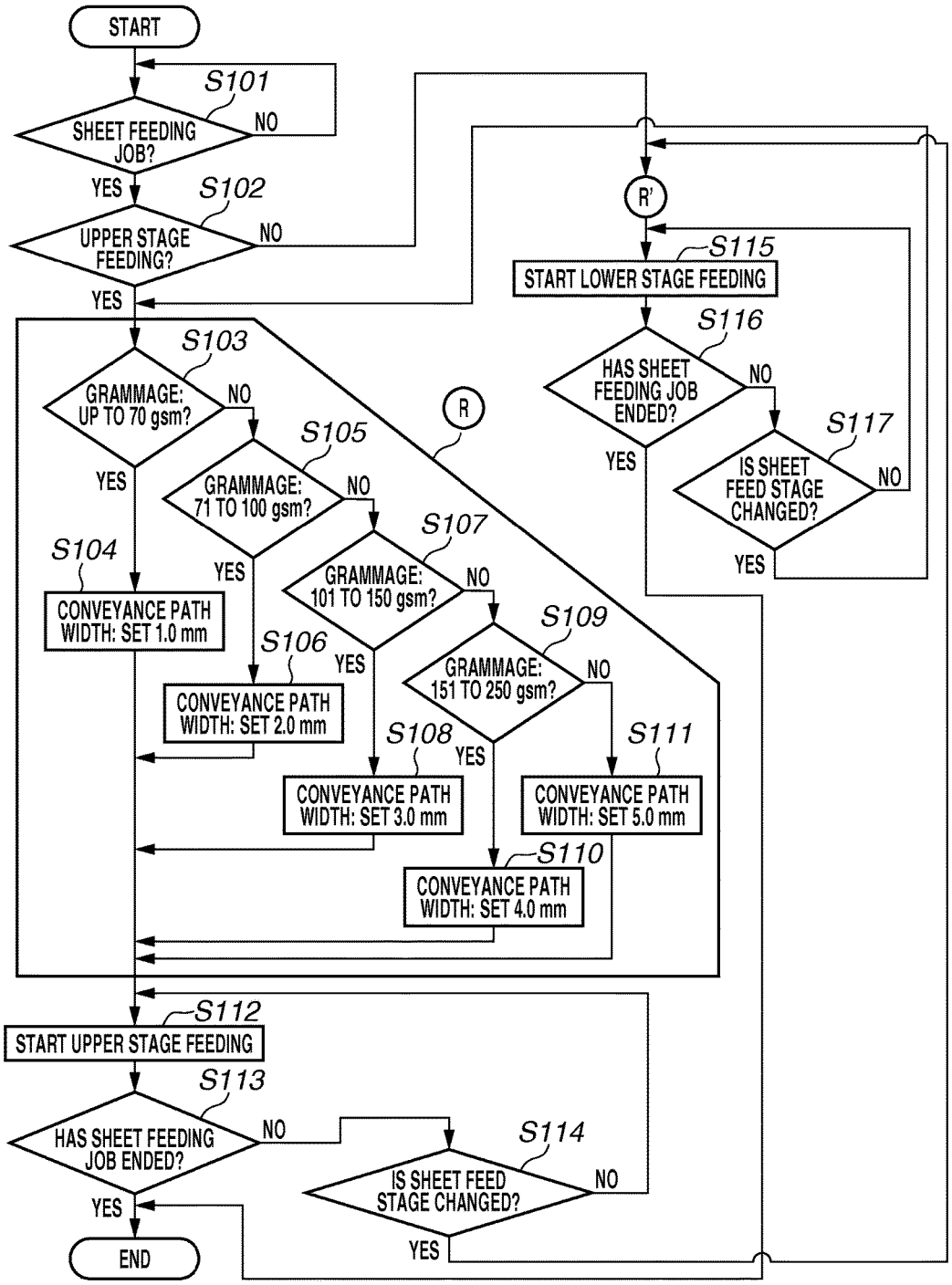
FIG. 9 is a flow chart illustrating a processing procedure of the sheet feeding apparatus.

FIG. 9 is a flow chart when the CPU 1 as a control unit changes the conveyance path width according to the grammage of sheets to be conveyed.

In step S101, the CPU 1 of the sheet feeding apparatus 301 monitors until a sheet feeding job arises and when a sheet feeding job arises (YES in step S101), the processing proceeds to step S102. In step S102, the CPU 1 determines whether the storage that feeds sheet is an upper sheet feed stage, that is, the storage 11. In a case where the storage for feeding sheet is the upper storage 11 (YES in step S102), the processing proceeds to step S103. The CPU 1 changes the conveyance path width to a setting value illustrated in FIG. 7 based on the grammage of sheets being loaded on the upper storage 11 according to a flow R encircled by a line.

The flow encircled by the line R will be described. In step S103, the CPU 1 checks whether the set grammage set through the operation unit 4 of sheets being loaded on the upper storage 11 is 70 gsm or less. In a case where the CPU 1 determines that the set grammage is 70 gsm or less (YES in step S103), the processing proceeds to step S104. In step S104, the CPU 1 sets the conveyance path width to 1.0 mm and the processing proceeds to step S112.

In a case where the set grammage is not 70 gsm or less (NO in step S103), the processing proceeds to step S105. In step S105, the CPU 1 checks whether the set grammage is 71 to 100 gsm. In a case where the CPU 1 determines that the set grammage is 71 to 100 gsm (YES in step S105), the processing proceeds to step S106. In step S106, the CPU 1 sets the conveyance path width to 2.0 mm and the processing proceeds to step S112.

In a case where the set grammage is not 71 to 100 gsm (NO in step S105), the processing proceeds to step S107. In step S107, the CPU 1 checks whether the set grammage is 101 to 150 gsm. In a case where the CPU 1 determines that the set grammage is 101 to 150 gsm (YES in step S107), the processing proceeds to step S108. In step S108, the CPU 1 sets the conveyance path width to 3.0 mm and the processing proceeds to step S112.

In a case where the set grammage is not 101 to 150 gsm (NO in step S107), the processing proceeds to step S109. In step S109, the CPU 1 checks whether the set grammage is 151 to 250 gsm. In a case where the CPU 1 determines that the set grammage is 151 to 250 gsm (YES in step S109), the processing proceeds to step S110. In step S110, the CPU 1 sets the conveyance path width to 4.0 mm and the processing proceeds to step S112.

In a case where the set grammage is not 151 to 250 gsm (NO in step S109), the processing proceeds to step S111. In step S111, the CPU 1 sets the conveyance path width to the maximum 5.0 mm and the processing proceeds to step S112.

The conveyance path width is set to the width according to the grammage in such a manner that the CPU 1 controls the rotation amount of the upper guide moving motor 73 and the lower guide moving motor 74 via the drive circuits 75 and 76.

After the conveyance path width is changed, in step S112, the CPU 1 starts to feed sheets from the upper storage 11.

Subsequently, in step S113, in a case where the sheet feeding job has ended (YES in step S113), the CPU 1 ends the processing procedure. In a case where, in step S113, the sheet feeding job has not yet ended (NO in step S113), the processing proceeds to step S114. In a case where the sheet feed stage is not changed (NO in step S114), the processing returns to step S112. The CPU 1 continues upper-stage sheet feeding. If the sheet feed stage is changed (YES in step S114), the processing proceeds to a flow R' that changes the conveyance path width based on grammage of sheets loaded on the lower-stage repository 372. In a flow R', like the aforementioned flow R, the conveyance path width is changed to a setting value based on the grammage of sheets being loaded on the lower sheet feed stage, that is the lower storage 372. After the conveyance path width is changed in the flow R', in step S115, the CPU 1 starts to feed sheets from the lower storage 372. Subsequently, in step S116, if the sheet feeding job has ended (YES in step S116), the CPU 1 ends the job. In a case where, in step S116, the sheet feeding job has not yet ended (NO in step S116), the processing proceeds to step S117. In a case where the sheet feed stage is not changed (NO in step S117), the processing returns to step S115. The CPU 1 continues lower-stage sheet feeding. In a case where the sheet feed stage is changed (YES in step S117), the processing proceeds to the flow R. After the conveyance path width is changed, in step S112, the CPU 1 starts to feed sheets from the upper storage 11.

The conveyance path width in the detection area of the detection unit 22 is varied according to the grammage of sheets to be conveyed by the control being executed by the CPU 1 according to the flowchart illustrated in FIG. 9, so that a stable sheet orientation is always maintained in the detection area. Accordingly, the precision of detection by the ultrasonic sensor can be improved and double feed of sheets can reliably be detected.

In addition, the precision of detecting the grammage of sheets can also be improved. With improved precision of detecting the grammage of sheets, sheet grammage is determined more precisely compared to the case where the grammage of sheets input with a predetermined width through the operation unit 4 in advance. Even if the user makes a grammage setting error, image forming parameters of the image forming apparatus body 300, for example, the fixing temperature of the fixing device and the like can be set to the optimal ones according to the sheet grammage.

Figure 10A:
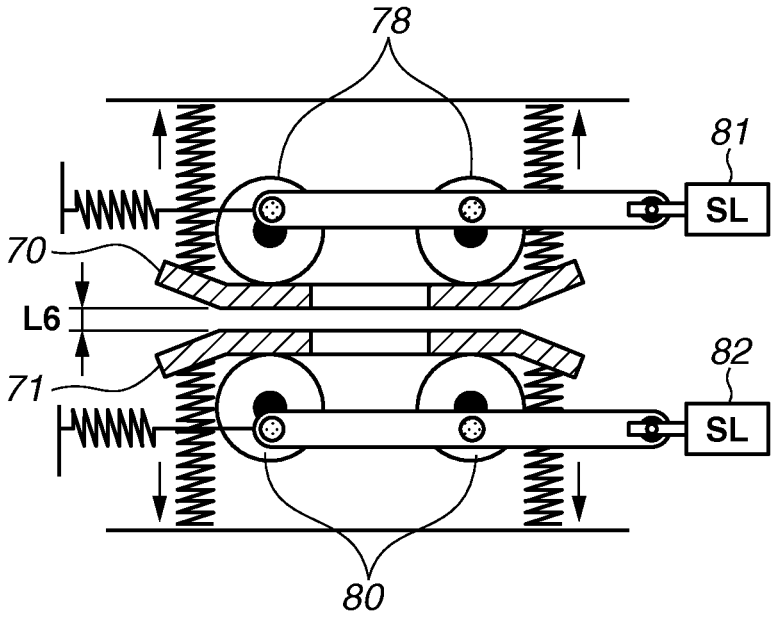
FIGS. 10A and 10B are diagrams each illustrating the operation of the conveyance path width change in a modified example.

In the present exemplary embodiment, the upper guide moving motor 73 and the lower guide moving motor 74 are used for moving the conveyance guides 70 and 71, so that the five-stage conveyance path width illustrated in FIG. 7 is implemented. However, the drive unit for moving the upper conveyance guide 70 and the lower conveyance guide 71 is not limited to a motor. For example, as illustrated in FIGS. 10A and 10B, the drive unit may be structured using an attraction force of solenoids 81 and 82 in a W direction illustrated in FIG. 10B.

Figure 10B:
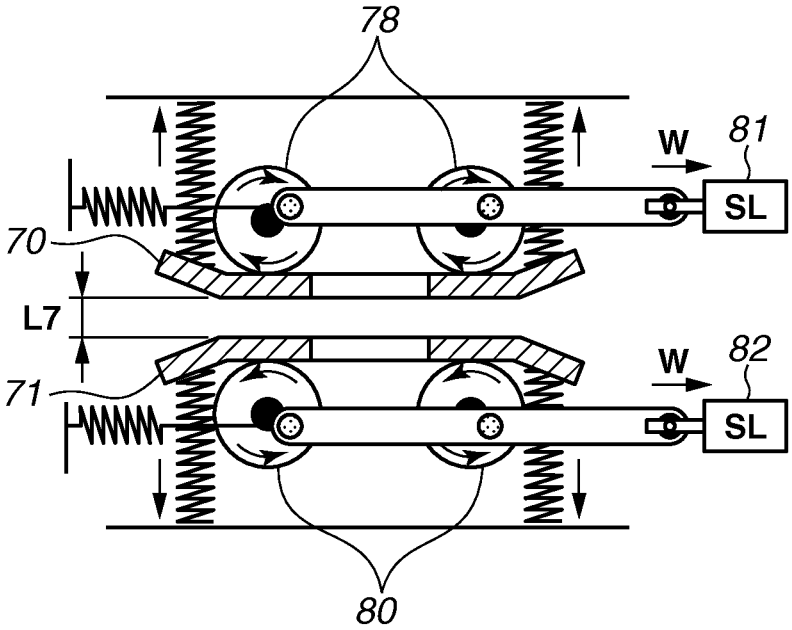

That is, the conveyance path width may be widened from L6 to L7 by pulling each of the solenoids 81 and the solenoid 82 in the W direction illustrated in FIG. 10B so that the upper conveyance guide 70 is moved upward and the lower conveyance guide 71 is moved downward. Whether to energize the solenoids 81 and 82 as drive units for moving the upper conveyance guide 70 and the lower conveyance guide 71 is controlled by the CPU 1.

Figure 11A:
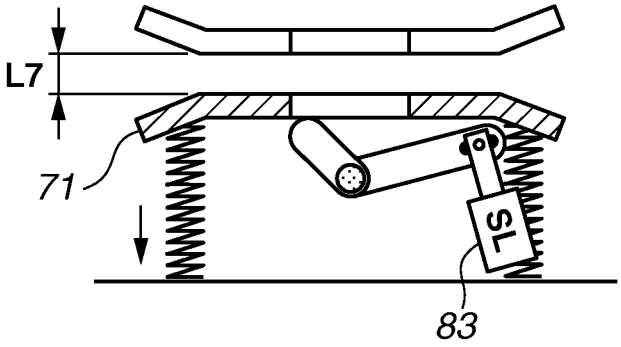
FIGS. 11A and 11B are diagrams each illustrating the operation of the conveyance path width change in a modified example.
Figure 11B:
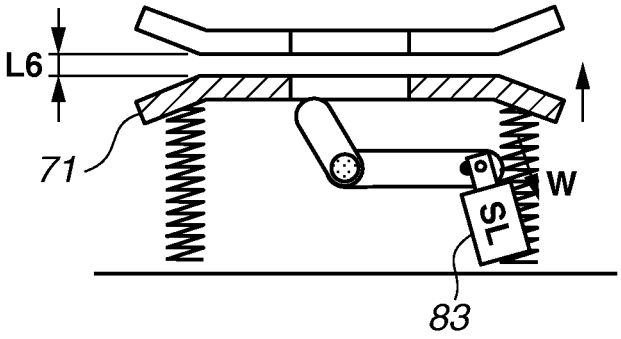
Figure 12A:
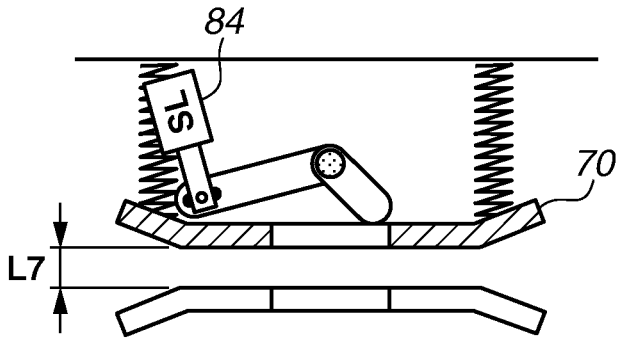
FIGS. 12A and 12B are diagrams each illustrating the operation of the conveyance path width change in a modified example.
Figure 12B:
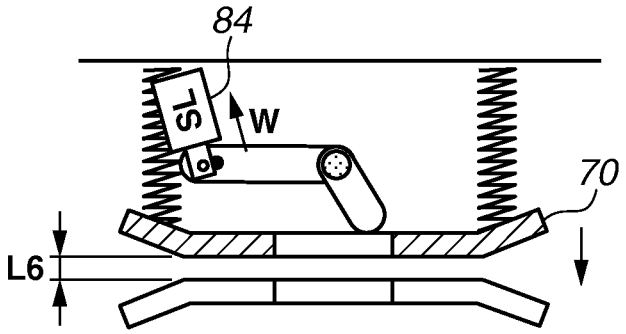

Instead of moving both of the upper conveyance guide 70 and the lower conveyance guide 71, the present exemplary embodiment may be configured in such a manner that only one conveyance guide of the upper conveyance guide 70 and the lower conveyance guide 71 is moved. For example, only the lower conveyance guide 71 may be moved by using, as illustrated in FIG. 11A, a solenoid 83 and pulling, as illustrated in FIG. 11B, the solenoid 83 in a W direction illustrated in FIG. 11B. Conversely, only the upper conveyance guide 70 may be moved by using, as illustrated in FIG. 12A, a solenoid 84 and pulling, as illustrated in FIG. 12B, the solenoid 84 in a W direction illustrated in FIG. 12B.

In a system in which the conveyance guides are moved using these solenoids, as illustrated in FIG. 13, the conveyance path width is configured in such a manner that two-stage path widths are set depending on the grammage of sheets to be conveyed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-217361, filed Oct. 24, 2014, which is hereby incorporated by reference herein in its entirety.

What is claimed is:

1. A sheet conveyance apparatus comprising:

a transmission unit configured to transmit an ultrasonic wave toward a sheet being conveyed;

a reception unit arranged opposite to the transmission unit across the sheet and configured to receive the ultrasonic wave;

a conveyance guide unit configured to form a conveyance path through which the sheet being conveyed between the transmission unit and the reception unit passes;

an acquisition unit configured to acquire grammage information about grammage of the sheet to be conveyed;

a change unit configured to change a distance of the conveyance path in a thickness direction of the sheet; and a control unit configured to control the change unit to set the distance of the conveyance path in the thickness direction of the sheet according to the grammage information acquired by the acquisition unit, wherein, in a case where the grammage information indicates that grammage of the sheet is first grammage, the control unit controls the change unit to set the distance of the conveyance path in such a manner that the distance of the conveyance path in the thickness direction of the sheet becomes larger than in a case where the grammage information indicates that grammage of the sheet is second grammage which is smaller than the first grammage.

2. The sheet conveyance apparatus according to claim 1, wherein whether double sheet feed occurs is determined based on a signal of the received ultrasonic wave.

3. The sheet conveyance apparatus according to claim 1, further comprising a setting unit configured to set grammage information about grammage of the sheet to be conveyed, wherein the acquisition unit acquires the grammage information set by the setting unit.

4. The sheet conveyance apparatus according to claim 1, wherein the control unit controls the change unit to set, by moving the conveyance guide unit, the distance of the conveyance path in the thickness direction of the sheet near an area through which the ultrasonic wave transmitted by the transmission unit and received by the reception unit propagates.

5. The sheet conveyance apparatus according to claim 1, wherein the conveyance guide unit includes a first guide member and a second guide member arranged opposite to the first guide member, wherein the sheet passes between the first guide member and the second guide member, and wherein the control unit controls the change unit to set the distance between the first guide member and the second guide member in the thickness direction of the sheet by moving both of the first guide member and the second guide member in the thickness direction of the sheet to be conveyed.

6. The sheet conveyance apparatus according to claim 1, wherein the conveyance guide unit includes a first guide member and a second guide member arranged opposite to the first guide member, and wherein the change unit moves only one of the first guide member and the second guide member in the thickness direction of the sheet to be conveyed.

7. An image forming apparatus comprising:

a transmission unit configured to transmit an ultrasonic wave toward a sheet being conveyed;

a reception unit arranged opposite to the transmission unit across the sheet and configured to receive the ultrasonic wave;

a conveyance guide unit configured to form a conveyance path through which the sheet being conveyed between the transmission unit and the reception unit passes;

an image forming unit configured to form an image on the sheet guided by the conveyance guide unit;

an acquisition unit configured to acquire sheet information about the sheet to be conveyed;

a change unit configured to change a distance of the conveyance path in a thickness direction of the sheet; and a control unit configured to control the change unit to change the distance of the conveyance path according to the acquired sheet information.

8. The image forming apparatus according to claim 7, further comprising a setting unit configured to set grammage information about grammage of the sheet to be conveyed, wherein the acquisition unit acquires the grammage information set by the setting unit.

9. The image forming apparatus according to claim 7, wherein the control unit controls the change unit to set, by moving the conveyance guide unit, the distance of the conveyance path in the thickness direction of the sheet near an area through which the ultrasonic wave transmitted by the transmission unit and received by the reception unit propagates.

10. The image forming apparatus according to claim 7, wherein the conveyance guide unit includes a first guide member and a second guide member arranged opposite to the first guide member, wherein the sheet passes between the first guide member and the second guide member, and wherein the control unit controls the change unit to set the distance between the first guide member and the second guide member in the thickness direction of the sheet by moving both of the first guide member and the second guide member in the thickness direction of the sheet to be conveyed.

11. The image forming apparatus according to claim 7, wherein the conveyance guide unit includes a first guide member and a second guide member arranged opposite to the first guide member, and wherein the change unit moves only one of the first guide member and the second guide member in the thickness direction of the sheet to be conveyed.

12. The image forming apparatus according to claim 7, wherein the acquisition unit acquires grammage information about grammage of the sheet as the sheet information, and wherein in a case where the grammage information indicates that grammage of the sheet is first grammage, the control unit controls the change unit to set the distance of the conveyance path in the thickness direction of the sheet larger than the distance of the case where the grammage information indicates that grammage of the sheet is second grammage, which is smaller than the first grammage.

13. The image forming apparatus according to claim 7, wherein the image forming unit includes a fixing unit configured to fix the image to the sheet by heat, and wherein a temperature of the fixing unit is controlled based on a signal of the received ultrasonic wave.

14. The image forming apparatus according to claim 7, wherein whether double sheet feed occurs is determined based on output from the reception unit.

15. The image forming apparatus according to claim 14, wherein the sheet is discharged, if double sheet feed occurs, without being conveyed to the image forming unit.

16. The image forming apparatus according to claim 14, wherein the sheet is stopped, if double sheet feed occurs, without being conveyed to the image forming unit.

17. The image forming apparatus according to claim 7, wherein the conveyance guide unit includes a first guide member and a second guide member arranged opposite to the first guide member, wherein the sheet passes between the first guide member and the second guide member, and wherein the control unit controls the change unit to set the distance between the first guide member and the second guide member in the thickness direction of the sheet by moving only one of the first guide member and the second guide member in the thickness direction of the sheet to be conveyed.

18. A sheet conveyance apparatus comprising:

a double sheet feed detector, including a transmitter and a receiver arranged opposite to the transmitter across the sheet, configured to detect whether double sheet feed occurs based on an output from the receiver;

a conveyance guide unit configured to form a conveyance path through which the sheet being conveyed between the transmitter and the receiver passes;

an acquisition unit configured to acquire grammage information about grammage of the sheet to be conveyed;

a change unit configured to change a distance of the conveyance path in a thickness direction of the sheet; and a control unit configured to control the change unit to set the distance of the conveyance path in the thickness direction of the sheet according to the grammage information acquired by the acquisition unit, wherein, in a case where the grammage information indicates that grammage of the sheet is first grammage, the control unit controls the change unit to set the distance of the conveyance path in such a manner that the distance of the conveyance path in the thickness direction of the sheet becomes larger than in a case where the grammage information indicates that grammage of the sheet is second grammage which is smaller than the first grammage, and wherein the double sheet feed detector detects whether double sheet feed occurs in a state where the distance of the conveyance path in the thickness direction of the sheet is changed by the change unit.

19. The sheet conveyance apparatus according to claim 18, wherein the transmitter transmits an ultrasonic wave toward the sheet being conveyed and the receiver receives the ultrasonic wave transmitted by the transmitter, and wherein the double sheet feed detector detects whether double sheet feed occurs based on a signal of the ultrasonic wave received by the receiver.

20. The sheet conveyance apparatus according to claim 18, further comprising a setting unit configured to set grammage information about grammage of the sheet to be conveyed, wherein the acquisition unit acquires the grammage information set by the setting unit.

21. An image forming apparatus comprising:

an image forming unit configured to form an image on a sheet;

a double sheet feed detector, including a transmitter and a receiver arranged opposite to the transmitter across the sheet, configured to detect whether double sheet feed occurs based on an output from the receiver;

a conveyance guide unit configured to form a conveyance path through which the sheet being conveyed between the transmitter and the receiver passes;

an acquisition unit configured to acquire grammage information about grammage of the sheet to be conveyed;

a change unit configured to change a distance of the conveyance path in a thickness direction of the sheet; and a control unit configured to control the change unit to set the distance of the conveyance path in the thickness direction of the sheet according to the grammage information acquired by the acquisition unit, wherein, in a case where the grammage information indicates that grammage of the sheet is first grammage, the control unit controls the change unit to set the distance of the conveyance path in such a manner that the distance of the conveyance path in the thickness direction of the sheet becomes larger than in a case where the grammage information indicates that grammage of the sheet is second grammage which is smaller than the first grammage, and wherein the double sheet feed detector detects whether double sheet feed occurs in a state where the distance of the conveyance path in the thickness direction of the sheet is changed by the change unit.

22. The image forming apparatus according to claim 21, wherein the transmitter transmits an ultrasonic wave toward the sheet being conveyed and the receiver receives the ultrasonic wave transmitted by the transmitter, and wherein the double sheet feed detector detects whether double sheet feed occurs based on output from the receiver.

23. The image forming apparatus according to claim 21, further comprising a setting unit configured to set grammage information about grammage of the sheet to be conveyed, wherein the acquisition unit acquires the grammage information set by the setting unit.

24. The sheet conveyance apparatus according to claim 1, wherein the conveyance guide unit includes a first guide member and a second guide member arranged opposite to the first guide member, wherein the sheet passes between the first guide member and the second guide member, and wherein the control unit controls the change unit to set the distance between the first guide member and the second guide member in the thickness direction of the sheet by moving only one of the first guide member and the second guide member in the thickness direction of the sheet to be conveyed.

* * * * *